US008052301B2

(12) United States Patent
Zhou et al.

(10) Patent No.: US 8,052,301 B2
(45) Date of Patent: Nov. 8, 2011

(54) LED LAMP

(75) Inventors: Qin-Fei Zhou, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 315 days.

(21) Appl. No.: 12/417,664

(22) Filed: Apr. 3, 2009

(65) Prior Publication Data

US 2010/0157593 A1 Jun. 24, 2010

(51) Int. Cl.
*F21S 4/00* (2006.01)
*F21V 21/00* (2006.01)

(52) U.S. Cl. ..... 362/249.02; 362/294

(58) Field of Classification Search ..... 362/217.05, 362/218, 219, 249.02, 294, 296.01
See application file for complete search history.

(56) References Cited

U.S. PATENT DOCUMENTS

| | | | | |
|---|---|---|---|---|
| 7,033,060 | B2 * | 4/2006 | Dubuc | 362/600 |
| 2007/0285922 | A1 * | 12/2007 | Chen | 362/240 |
| 2007/0285927 | A1 * | 12/2007 | Chen | 362/294 |
| 2009/0219713 | A1 * | 9/2009 | Siemiet et al. | 362/218 |
| 2009/0296381 | A1 * | 12/2009 | Dubord | 362/218 |

FOREIGN PATENT DOCUMENTS

| | | | |
|---|---|---|---|
| CN | 2509434 | Y | 9/2002 |
| CN | 1737418 | A | 2/2006 |

* cited by examiner

*Primary Examiner* — David V Bruce
(74) *Attorney, Agent, or Firm* — Altis Law Group, Inc.

(57) ABSTRACT

An LED lamp includes a bracket, a supporting plate mounted on the bracket, and a plurality of LED modules mounted on the supporting plate. The bracket includes a bottom plate, two sidewalls and two engaging portions. The two sidewalls respectively connect to two opposite sides of the bottom plate and extend upwardly from the bottom plate. Two protruded portions respectively obliquely extend from inner surfaces of the two sidewalls to define two grooves therebelow, respectively. The supporting plate has two opposite sides respectively slidably received in the grooves. A bottom surface of the supporting plate thermally contacts with a top surface the bottom plate. The LED modules are mounted on a top surface of the supporting plate.

16 Claims, 5 Drawing Sheets

LED LAMP

BACKGROUND

1. Technical Field

The invention relates to LED lamps and, more particularly, to an LED lamp having a number of LED modules which can be easily assembled to or disassembled from the LED lamp to meet different luminous intensity requirements.

2. Description of Related Art

The technology of LEDs has rapidly developed in recent years from indicators to illumination applications. With the features of long-term reliability, environment friendliness and low power consumption, the LED is viewed as a promising alternative for future lighting products.

A conventional LED lamp comprises a bracket, a number of LED modules mounted on the bracket, and an envelope adhered to the bracket. Once the LED lamp is fixed under a determined circumstance, a luminous intensity of the LED lamp cannot be changed to meet different requirements. Generally, when it is necessary to change the luminous intensity, the LED lamp needs being totally dissembled and reassembled or redesigned, which is unduly time-consuming and raises production costs.

What is needed, therefore, is an LED lamp having a number of LED modules which can be easily assembled to or disassembled from the LED lamp to meet different luminous intensity requirements.

DETAILED DESCRIPTION

Figure 1:
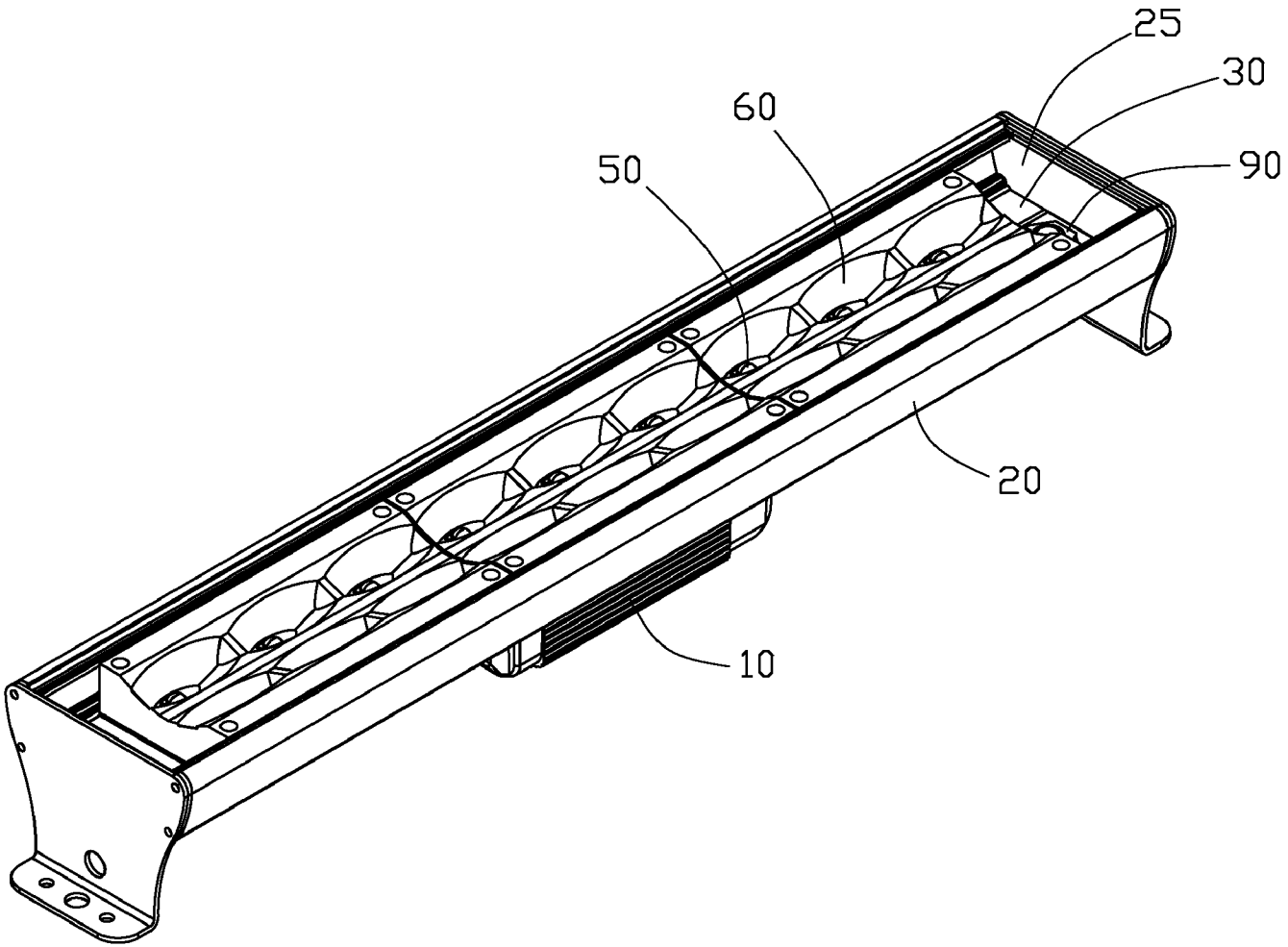
FIG. 1 is an assembled, isometric view of an LED lamp in accordance with an embodiment of the present disclosure.
Figure 2:
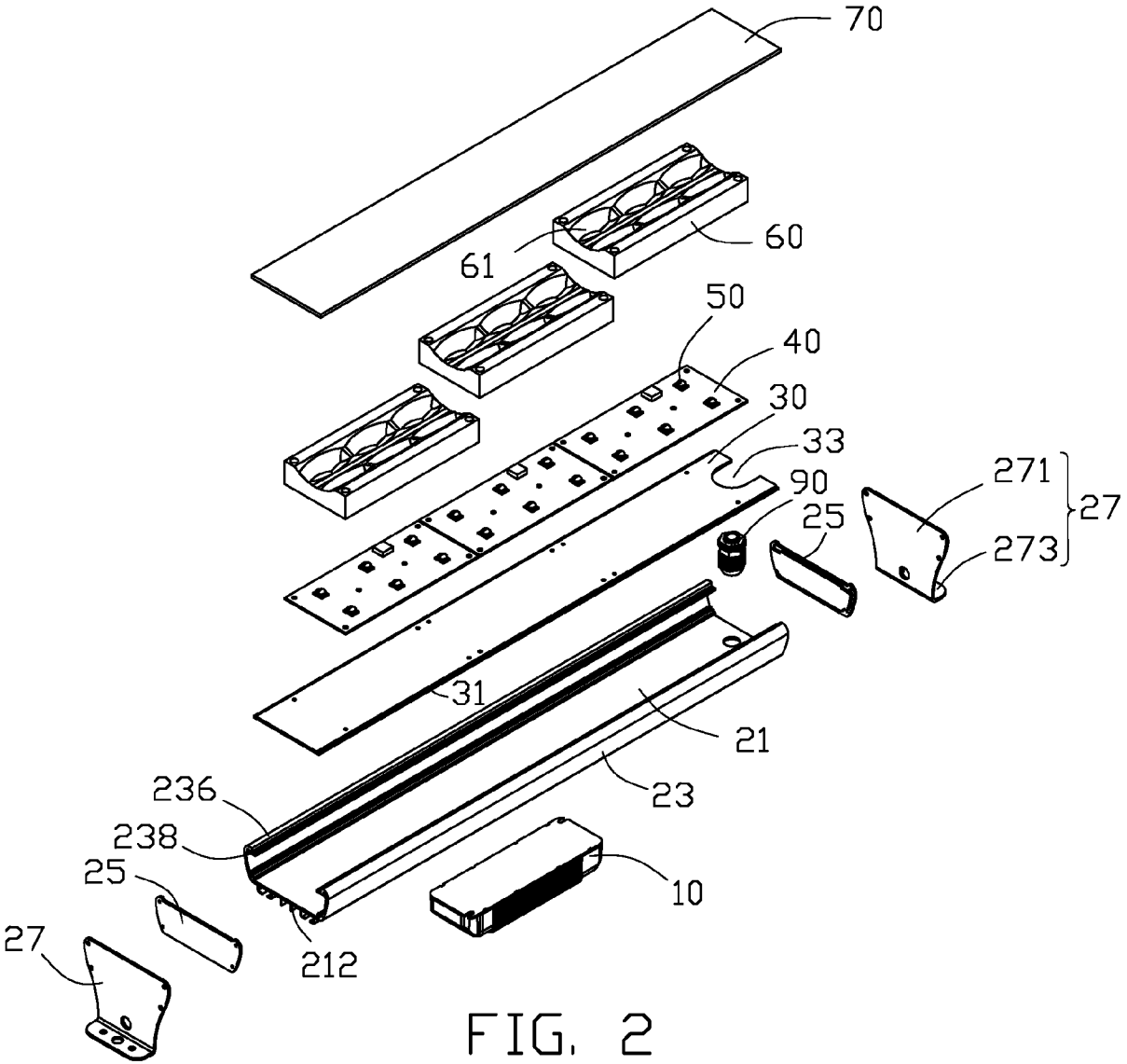
FIG. 2 is an exploded view of the LED lamp in FIG. 1.

Referring to FIGS. 1-2, an LED lamp of an embodiment comprises a bracket 20, a supporting plate 30 embedded in the bracket 20, three printed circuit boards (PCBs) 40 mounted on a top surface of the supporting plate 30, a number of LED modules 50 mounted on the PCBs 40, three reflectors 60 covering the LED modules 50, and a transparent envelope 70 located at a top of the reflectors 60 and mounted on a top portion of the bracket 20. A driving circuit module 10 is mounted on a bottom side of the bracket 20 and electronically connects with the LED modules 50.

Figure 3:
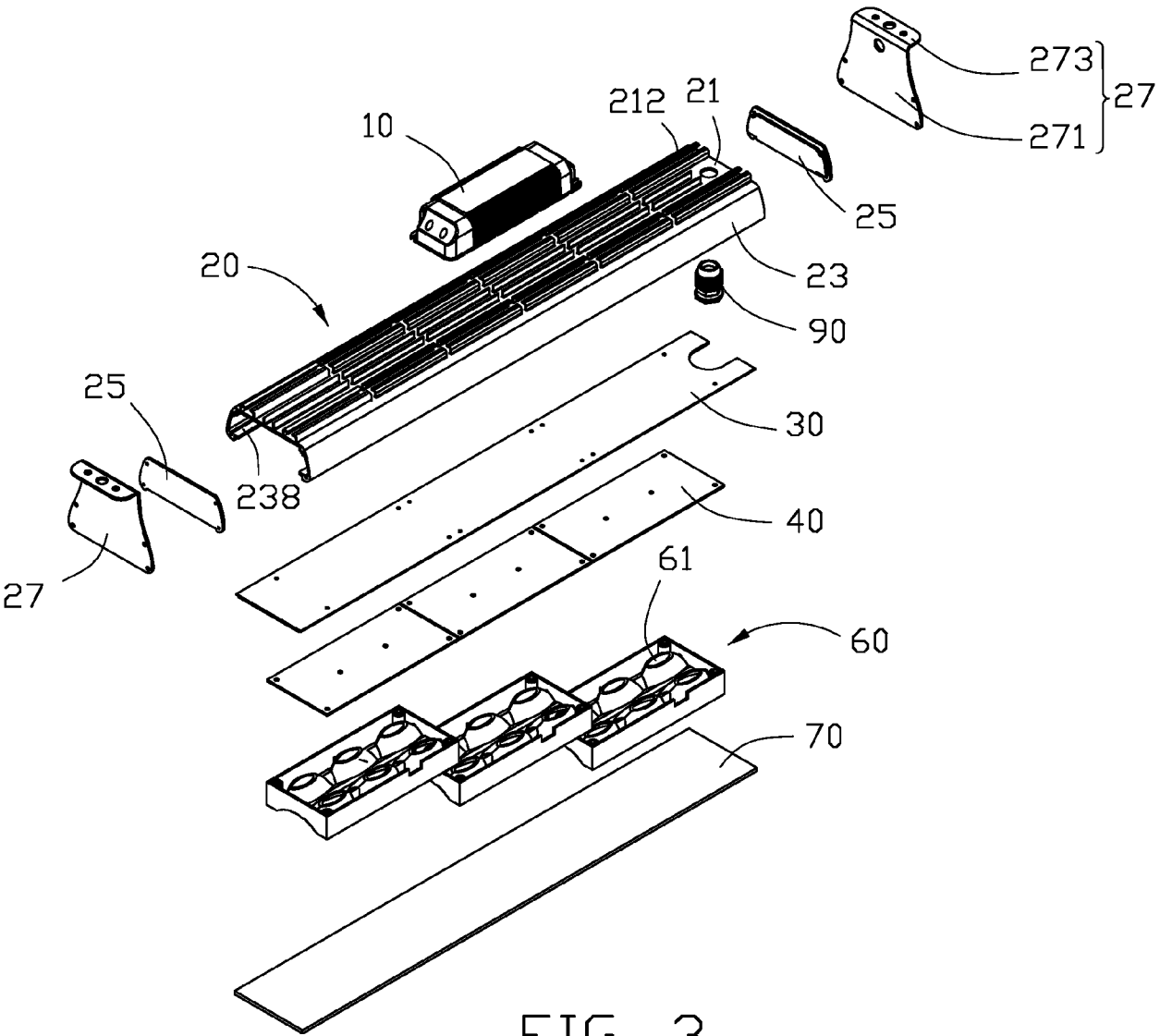
FIG. 3 is an inverted view of the LED lamp in FIG. 2.
Figure 4:
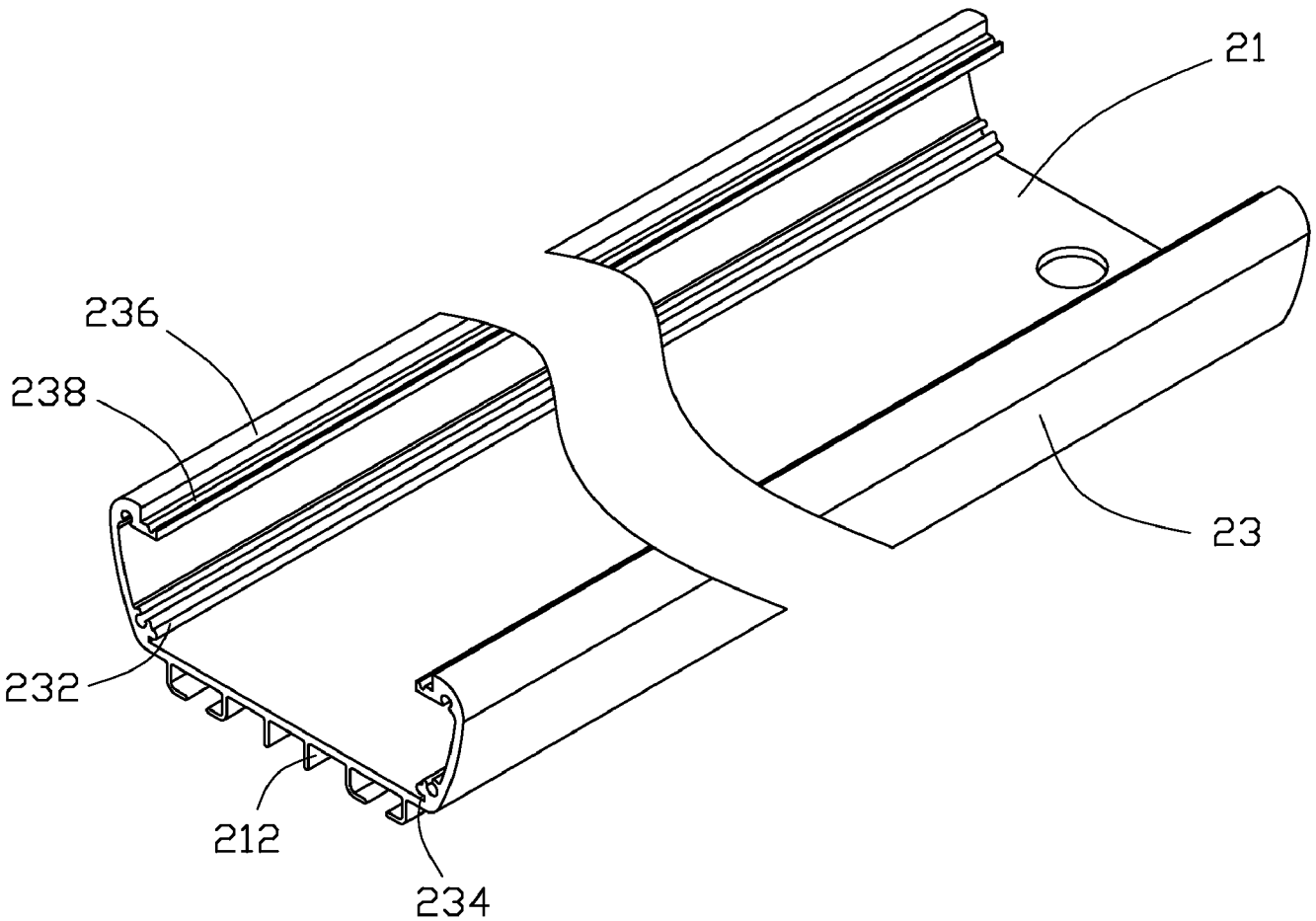
FIG. 4 is an isometric view of a bracket of the LED lamp of FIG. 1.
Figure 5:
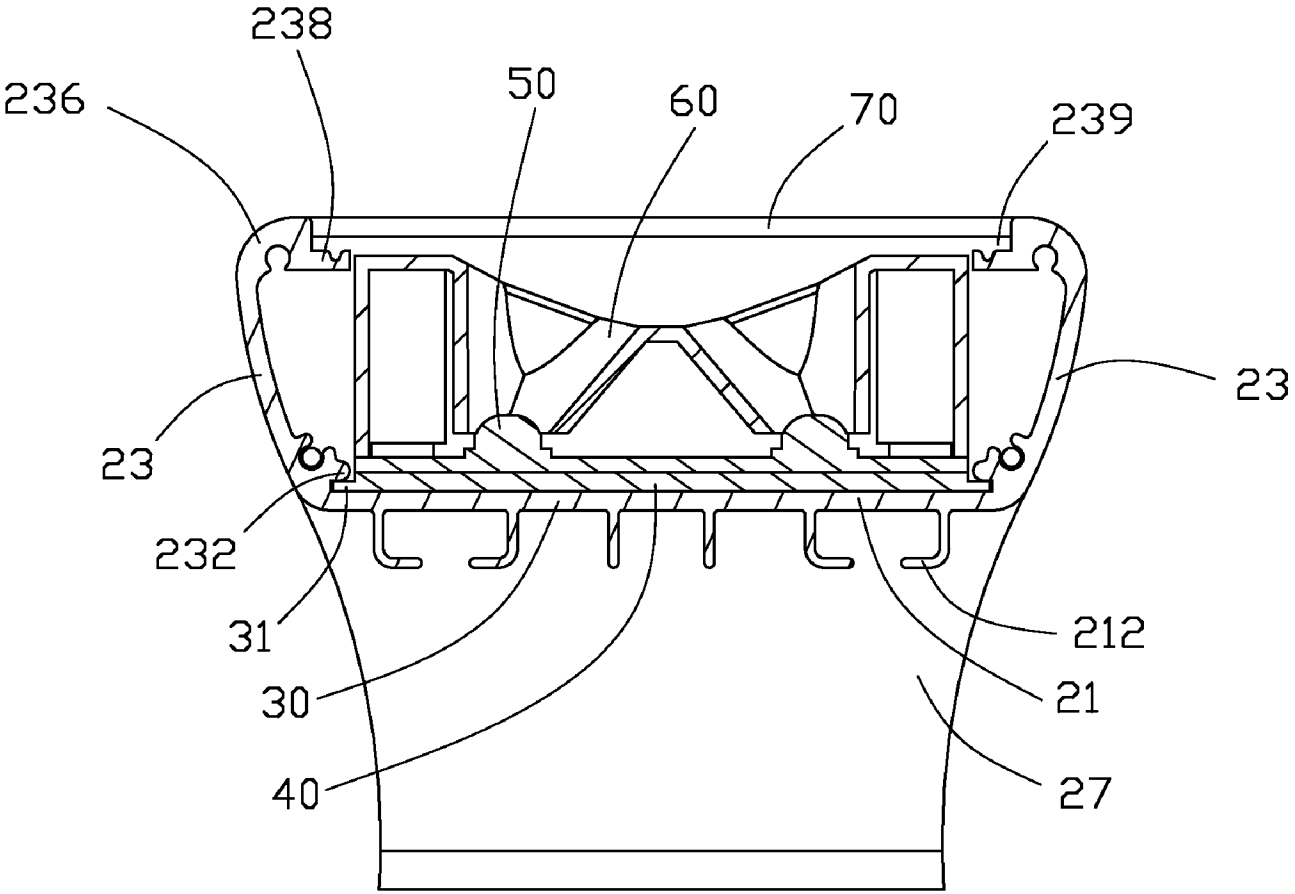
FIG. 5 is a cross-sectional view of the LED lamp in FIG. 1.

Referring to FIGS. 3-5 also, the bracket 20 is integrally formed by aluminum and has a U-shaped configuration. The bracket 20 comprises an elongated bottom plate 21, two arc-shaped sidewalls 23 and two mounting plates 27. The two sidewalls 23 extend outwardly and upwardly from front and rear edges of the bottom plate 21. The two mounting plates 27 are mounted on two opposite lateral ends of the bottom plate 21.

The bottom plate 21 has an top surface and a bottom surface. A number of fins 212 extend downwardly from the bottom surface of the bottom plate 21 to dissipate heat of the bracket 20 absorbed from the LED modules 50. Each of the sidewalls 23 has a convex outer surface and a concave inner surface opposite to the convex outer surface. An elongated protruded portion 232 protrudes slantwise upwardly from a bottom end of the inner surface of each of the sidewalls 23 and extends along a lengthwise direction of the bracket 20. The protruded portion 232 extends obliquely over to the top surface of the bottom plate 21, and therefore an elongated groove 234 is defined between the protruded portion 232 and the top surface of the bottom plate 21. Opposite ends of the supporting plate 30 are received in the two grooves 234.

An inverted U-shaped transition portion 236 extends upwardly and inwardly from a top end of the sidewall 23. A length of the transition portion 236 is equal to that of the sidewall 23. An elongated engaging portion 238 extends inwardly and horizontally from a bottom end of the transition portion 236. A bottom surface of the engaging portion 238 and a bottom surface of the transition portion 236 are coplanar, while a top surface of the engaging portion 238 is below a top surface of the transition portion 236. In the present embodiment, the transition portion 236 and the engaging portion 238 form a step 239 for supporting an edge portion of the envelope 70. A height of the step 239 is equals to a distance between the top surface of the engaging portion 238 and the top surface of the transition portion 236. The height of the step 239 is larger than a thickness of the edge portion of the envelope 70. The two engaging portions 238 are oriented toward each other to corporately support the envelope 70. Opposite edge portions of the envelope 70 sit on the top surfaces of the engaging portions 238 and abut against the transition portions 236. When the envelope 70 is mounted on the bracket 20, top surface of the edge portions of the envelope 70 are located below the top surfaces of the transition portions 236.

Each of the mounting plates 27 is a bended metal sheet and has an L-shaped configuration. The mounting plate 27 comprises a baffling portion 271 and a mounting portion 273 extending outwardly from a bottom end of the baffling portion 271. The two baffling portions 271 of the two mounting plates 27 are mounted on the lateral ends of the bracket 20 to enclose the supporting plate 30, the PCBs 40, the LED modules 50 and the reflectors 60 in the bracket 20. The two mounting portions 273 are used to mount the LED lamp at a predetermined position such as a wall, a floor or a ceiling. Two cushions 25 are sandwiched between the bracket 20 and the baffling portions 271 respectively to enhance hermeticity of the bracket 20.

The supporting plate 30 is an elongated metal plate. Two extending portions 31 extend outwardly from front and rear edges of the supporting plate 30, respectively. The extending portions 31 extend horizontally and outwardly from lower portions of the front and rear edges of the supporting plate 30, respectively. A length of the extending portion 31 is equal to that of the supporting plate 30. A width of the extending portion 31 is equal to or slightly less than a depth of the groove 234 of the bracket 20. A width between the two extending portions 31 is equal to that of between the sidewalls 23 of the bracket 20 where the grooves 234 are located. The extending portion 31 is used to insert in a corresponding groove 234 of the bracket 20. A cutout 33 is defined at a right end of the supporting plate 30.

The PCBs 40 align with each other and are mount on a top surface of the supporting plate 30. A total length of the PCBs 40 is shorter than that of the supporting plate 30. When the PCBs 40 are mounted in the supporting plate 30, the cutout 33 is located outside the PCBs 40. Each of the reflectors 60 covers a corresponding PCB 40. The reflector 60 defines a plurality of through holes 61 to receive the LED modules 50 in the through holes 61.

In assembly, the PCBs 40 are mounted on the top surface of the supporting plate 30 and the reflectors 60 are mounted on the PCBs 40 and cover the LED modules 50 on the PCBs 40.

In this state, the cutout 33 of the supporting plate 30 is located outside the PCBs 40. The PCB 40 with LED modules 50 and the reflector 60 form a light module. The driving circuit module 10 is mounted on the bottom side of the bottom plate 21 of the bracket 20. A tube-shaped wire guide 90 extends through the bottom plate 21 and is mounted on the bottom plate 21. The extending portions 31 are inserted in the grooves 234 and slide along the grooves 234 until an edge of the supporting plate 30 defining the cutout 33 abuts against a periphery of the wire guide 90. In this state, the supporting plate 30 is received in the bracket 20 and thermally contacts with the top surface of the bottom plate 21. The baffling portions 271 of the mounting plates 27 are mounted on the lateral ends of the bracket 20 respectively. The cushions 25 are sandwiched between the bracket 20 and the baffling portions 271, respectively. Wires (not shown) of the driving circuit module 10 extend through the wire guide 90 and electronically connect with the LED modules 50. The envelope 70 adheres to the engaging portions 238. The envelope 70 abuts against the transition portions 236 of the bracket 20 and the cushions 25. The envelope 70, the bracket 20, the cushions 25 and the baffling portions 271 of the mounting plates 27 define a hermetic chamber. In this state, the envelope 70 is located at a top of the reflectors 60 and spaced from the reflectors 60. The reflectors 60 are sandwiched between the engaging portions 238 and abut against the engaging portions 238. Thus, the LED lamp is assembled together.

In this embodiment, the supporting plate 30 is slideable along the grooves 234 of the bracket 20. Thus, the supporting plate 30 together with the light module which includes the PCB 40, the LED modules 50 and the reflector 60 can be easily assembled to or disassembled from the bracket 20 to change the number of the light module or to maintain the LED lamp by removing the left cushion 25 and mounting plate 27 from the bracket 20. The envelope 70 is spaced from the reflectors 60, thus, the envelope 70 is not necessary to disassembled from the bracket 20 when the supporting plate 30 is assembled to or disassembled from the bracket 20.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a bracket comprising a bottom plate, two sidewalls and two engaging portions, wherein the two sidewalls respectively connect to two opposite sides of the bottom plate and extend upwardly from the bottom plate, two opposite grooves are respectively defined in inner surfaces of the two sidewalls, the two engaging portions respectively extending inwardly from two top portions of the two sidewalls respectively;

a supporting plate having two opposite sides respectively slidably received in the two grooves of the two sidewalls and thermally contacting with the bottom plate of the bracket;

a plurality of light modules including LED modules mounted on a top surface of the supporting plate; and an envelope mounted on tops of the engaging portions of the bracket and spaced from the light modules.

2. The LED lamp as claimed in claim 1, wherein two extending portions respectively extend outwardly from the two opposite sides of the supporting plate and are respectively received in the two grooves of the two sidewalls.

3. The LED lamp as claimed in claim 2, wherein a protruded portion protrudes inwardly and upwardly from a bottom end of the inner surface of each of the sidewalls and extends along a lengthwise direction of each of the sidewalls, the protruded portion and the bottom plate of the bracket defining a corresponding one of the grooves therebetween.

4. The LED lamp as claimed in claim 1, wherein a plurality of fins extends downwardly from a bottom surface of the bottom plate.

5. The LED lamp as claimed in claim 1, wherein the light modules are sandwiched between the engaging portions and abut against the engaging portions, respectively.

6. The LED lamp as claimed in claim 1, wherein a transition portion is connected between a corresponding engaging portion and a top end of a corresponding sidewall.

7. The LED lamp as claimed in claim 6, wherein a bottom surface of the corresponding engaging portion and a bottom surface of the transition portion are coplanar, while a top surface of the corresponding engaging portion forms a step.

8. The LED lamp as claimed in claim 6, wherein a height of the step is a distance between the top surface of the corresponding engaging portion and the top surface of the transition portion.

9. The LED lamp as claimed in claim 6, wherein the height of the step is larger than a thickness of an edge portion of the envelope.

10. The LED lamp as claimed in claim 1, wherein two mounting plates are mounted on lateral ends of the bracket, respectively.

11. The LED lamp as claimed in claim 1, wherein each of the light modules comprises a printed circuit board with a plurality of LED modules and a reflector mounted on the printed circuit board and covering the LED modules, the reflector being spaced from the envelope.

12. An LED lamp comprising:

a bracket comprising a bottom plate and two sidewalls, wherein the two sidewalls respectively connect to two opposite sides of the bottom plate and extend upwardly from the bottom plate, two protruded portions respectively extending from inner surfaces of the two sidewalls, the protruded portions obliquely connecting with a top surface of the bottom plate;

a supporting plate having two opposite sides respectively slidably arranged between the protruded portions and the bottom plate of the bracket, a bottom surface of the supporting plate thermally contacting with the top surface the bottom plate;

a plurality of light modules with LED modules mounted on a top surface of the supporting plate.

13. The LED lamp as claimed in claim 12, wherein a plurality of fins extends downwardly from a bottom surface of the bottom plate.

14. The LED lamp as claimed in claim 12, wherein the sidewalls form engaging portion below tops thereof, the light modules are sandwiched between the engaging portions and abut against the engaging portions.

15. The LED lamp as claimed in claim 12, wherein a transition portion is connected between a corresponding engaging portion and a top end of a corresponding sidewall.

16. The LED lamp as claimed in claim 13, wherein a bottom surface of the engaging portion and a bottom surface of the transition portion are coplanar, while a top surface of the engaging portion forms a step, the envelope sitting on the step.

* * * * *